US006193587B1

(12) United States Patent
Lin et al.

(10) Patent No.: US 6,193,587 B1
(45) Date of Patent: Feb. 27, 2001

(54) APPARATUS AND METHOD FOR CLEANSING A POLISHING PAD

(75) Inventors: Chih-Lung Lin, Taipei; Y. C. Chang, Hsin-Chu, both of (TW)

(73) Assignee: Taiwan Semicondutor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/411,173

(22) Filed: Oct. 1, 1999

(51) Int. Cl.[7] ..... B26B 1/00

(52) U.S. Cl. ..... 451/56; 451/287; 451/443; 451/444

(58) Field of Search ..... 451/56, 287, 288, 451/443, 444

(56) References Cited

U.S. PATENT DOCUMENTS

| | | | | |
|---|---|---|---|---|
| 5,070,570 | * | 12/1991 | Sabo | 451/444 |
| 5,216,843 | * | 6/1993 | Breivogel | 451/56 |
| 5,384,986 | * | 1/1995 | Hirose et al. | 451/444 |
| 5,547,417 | * | 8/1996 | Breivogel et al. | 451/56 |
| 5,584,898 | * | 12/1996 | Fulton | 451/56 |
| 5,645,682 | * | 7/1997 | Skrovan | 451/56 |
| 5,879,226 | * | 3/1999 | Robinson | 451/287 |
| 5,904,615 | * | 5/1999 | Jeong et al. | 451/443 |
| 5,916,010 | * | 6/1999 | Varian et al. | 451/56 |
| 5,944,585 | * | 8/1999 | Nagahara et al. | 451/443 |
| 6,022,265 | * | 2/2000 | Drill et al. | 451/56 |
| 6,022,266 | * | 2/2000 | Bullard et al. | 451/56 |
| 6,042,457 | * | 3/2000 | Wilson et al. | 451/56 |

* cited by examiner

*Primary Examiner*—M. Rachuba
(74) *Attorney, Agent, or Firm*—Tung & Associates

(57) ABSTRACT

An apparatus and a method for cleaning a polishing pad used in a chemical mechanical polishing apparatus are disclosed. In the apparatus, a plurality of brush means is mounted to the bottom surface of either a conditioning head, a slurry delivery arm, or both for operating in-situ or ex-situ in a chemical mechanical polishing process. Each of the plurality of brush means may be formed of a multiplicity of bristles made of a polymeric material that is acid resistant and base resistant. A suitable material is nylon that has sufficient hardness for efficient cleaning of surface grooves in a top surface of the polishing pad. The present invention novel apparatus is efficient in removing particles from the surface grooves before the particles present a serious scratching hazard or otherwise damaging the wafer surface during a CMP polishing process. The present invention is further directed to a method for cleaning a polishing pad in a CMP apparatus by mounting a plurality of brush means to a bottom surface of a conditioning head or a slurry delivery arm such that surface grooves in the polishing pad can be cleaned in-situ or ex-situ in a chemical mechanical polishing process.

25 Claims, 5 Drawing Sheets

APPARATUS AND METHOD FOR CLEANSING A POLISHING PAD

FIELD OF THE INVENTION

The present invention generally relates to an apparatus and a method for cleaning a polishing pad used in a polishing process for electronic substrates and more particularly, relates to an apparatus and a method for conditioning and cleaning a polishing pad used in a chemical mechanical polishing process for semiconductor wafers that are capable of removing particles from surface grooves on the polishing pad and reducing failure rate of the wafers polished.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. No. 4,141,180 to Gill, Jr., et al.; U.S. Pat. No. 5,205,082 to Shendon et al; and, U.S. Pat. No. 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

Referring now to FIG. 1C, wherein an improved CMP head, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

In the improved CMP head 20 shown in FIG. 1C, large variations in the removal rate, or polishing rate, across the whole wafer area are frequently observed. A thickness variation across the wafer is therefore produced as a mean cause for wafer non-uniformity. The improved CMP head design, even though utilizing a pneumatic system to force a wafer surface onto a polishing pad, the pneumatic system cannot selectively apply different pressure at different locations on the surface of the wafer. For instance, as shown in FIG. 1D, a profilometer data obtained on an 8-inch wafer is shown. The thickness difference between the highest point on the wafer and the lowest point on the wafer is almost 2,000 Å yielding a standard deviation of 472 Å or 6.26%. The curve shown in FIG. 1D is plotted with the removal rates in the vertical axis and the distance from the center of the wafer in the horizontal axis. It is seen that the removal rates at the edges of the wafer are substantially higher than the removal rate at or near the center of the wafer. The thickness uniformity on the resulting wafer after the CMP process is therefore very poor.

The polishing pad 12 is a consumable item used in a semiconductor wafer fabrication process. For instance, under normal wafer fab conditions, the polishing pad must be replaced after a usage of between 12 and 18 hours. Polishing pads may be hard, incompressible pads or soft pads. For oxide polishing, hard, incompressible and thus stiffer pads are generally used to achieve planarity. Softer pads are frequently used to achieve improved uniformity and smooth surfaces. The hard pads and the soft pads may also be combined in an arrangement of stacked pads for customized applications.

A problem frequently encountered in using polishing pads in a CMP process for oxide planarization is the rapid deterioration in polishing rates of the oxide with successive wafers. The cause for the deterioration has been shown to be due to an effect known as "pad glazing" wherein the surface of the polishing pads become smooth such that the pads can no longer hold slurry in-between the fibers. This has been found to be a physical phenomenon on the surface, and is not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, reopen the pores, and thus forms micro scratches in the surface of the pad for improved life time of the pad surface. The pad conditioning process can be carried out either during a polishing process, i.e., known as concurrent conditioning, or after a polishing process.

While the pad conditioning process improves pad consistency and its lifetime, conventional apparatus of a conditioning disc is frequently not effective in conditioning a pad surface. For instance, a conventional conditioning disc for use in pad conditioning is shown in FIGS. 2A and 2B. The conditioning disc 30 is formed by embedding or encapsulating diamond particles 32 in nickel 34 coated on the surface 36 of a rigid substrate 38. FIG. 2A is a cross-sectional view of a new conditioning disc with all the diamond particles 32, 42 embedded in nickel 34. After repeated usage as a conditioning disc, the cross-sectional view of the disc 30 is shown in FIG. 2B which shows that diamond particle 42 has been lost and the top surfaces of the remaining particles 32 are flattened. The loss of diamond particle from nickel encapsulation 34 occurs frequently when the particle is not deeply embedded in the nickel metal 34. In the fabrication of the diamond particle conditioning disc 30, a nickel encapsulation 34 is first mixed with a diamond grit which included the diamond particles 32, 42 and applied to the rigid substrate 38. The bonding of the diamond particles 32, 42 is frequently insecure and thus the particles are easily lost from the nickel coating during usage. The diamond particle 42 which is lost from the nickel encapsulation 34 may be trapped between the surfaces of the polishing pad and the wafer and causes severe scratches on the wafer. Another drawback for the diamond conditioning disc is that the pad conditioning efficiency decreases through successive usage of the disc since the top surfaces of the diamond particles are flattened after repeated usage when the diamond grit mechanically abrades the pad surface.

Another processing difficulty frequently incurred in utilizing the pad conditioning disc is that while the conditioning disc may be effective in alleviating the pad glazing problem, it may not be effective in physically removing particles from the polishing pad surface, specifically, when the particles are trapped in the surface grooves. The source of the particles may be the diamond particles that have dislodged from the conditioning pad surface, coagulated or dried-up particles from the slurry solution or any other contaminating particles that may have fallen onto the polishing pad surface. The particle contamination problem becomes more serious with the continuous usage of the polishing pad since as the pad surface is gradually warned out, the depth of the grooves in the pad surface becomes smaller and thus no longer able to hold the particles therein. When the particles are released from the grooves onto the top of the polishing pad, severe scratching or other equally harmful damages to the wafer surface can occur.

FIGS. 3A, 3B and 3C are graphs illustrating the particle contamination problem on a polishing pad which is conditioned by a conventional conditioning head. For instance, FIG. 3A illustrates that at or near a pad life of 10–12.5 hours, the particle contamination problem becomes much more serious in that the failure rate doubles and quintuples those rates obtained at below the 10 hour pad life. This is a clear indication that, after 10 hours use of the polishing pad, the grooves become substantially shallower and are no longer capable of holding the contaminating particles therein. After a pad usage of more than 12.5 hours, the failure rate in wafer lots polished exceeds 50% which is clearly unacceptable. Similar trend is also seen in FIGS. 3B and 3C which illustrate the dependency of particle counts on the pad life and the dependency of particle counts on the fabrication dates, respectively. FIG. 3B shows that after a pad life of 10 hours, there is a significant increase (at a faster rate) in the particle counts. FIG. 3C illustrates the unacceptable particle counts (larger than 85) that occurred during a 20 day period obtained on a chemical mechanical polishing apparatus.

The particle contamination problem on a polishing pad surface is therefore and serious processing problem that must be resolved in order for the chemical mechanical polishing process to be used as a reliable planarization technique. In an attempt to solve the particle problem, efforts have been made to flush a polishing pad surface with high pressure deionized water jet to remove particles entrapped in the surface grooves. Other efforts have been made to manually clean the polishing pad after shutting down the chemical mechanical polishing apparatus by brushing. Neither method produces satisfactory results in obtaining a polishing pad surface that is substantially without particles. Moreover, the method either requires the complete shut-down of the polishing apparatus and thus a decrease in the fabrication yield, or requires an interruption of the polishing process in order to flush the pad with deionized water.

It is therefore an object of the present invention to provide an apparatus that is effective in cleaning a polishing pad that does not have the drawbacks and shortcomings of the conventional apparatus.

It is another object of the present invention to provide an apparatus for cleaning a polishing pad surface and removing substantially all the particles entrapped in the surface grooves of the pad.

It is a further object of the present invention to provide an apparatus for cleaning the surface of a polishing pad that can be used in-situ without requiring down time of the polishing apparatus.

It is still another object of the present invention to provide an apparatus for cleaning particles on the surface of a polishing pad by mounting a plurality of brush means on a pad conditioning head.

It is yet another object of the present invention to provide a method for cleaning particles from the surface of a polishing pad used in a chemical mechanical polishing apparatus that can be carried out in-situ in a wafer polishing process without incurring down time of the machine.

It is still another further object of the present invention to provide a method for removing particles from the surface grooves of a polishing pad in a chemical mechanical polishing apparatus by mounting a plurality of brush means on the surface of a pad conditioning head or on the surface of a slurry delivery arm.

It is yet another further object of the present invention to provide a chemical mechanical polishing apparatus that is equipped with a slurry delivery arm and a pad conditioning head wherein at least one of the arm and the head is mounted a plurality of brush means for cleaning particles from the surface grooves of a polishing pad.

SUMMARY OF THE INVENTION

In accordance with the present invention, an apparatus and a method for cleaning particles from the surface grooves of a polishing pad are provided.

In a preferred embodiment, a conditioning head for conditioning and cleaning a polishing pad by removing particles trapped in surface grooves is supplied which includes a disc holder for holding a conditioning disc therein, the disc holder has a peripheral region not covered by the conditioning disc, a plurality of apertures spaced-apart in a surface of the peripheral region each being adapted for holding a brush therein, and a plurality of brushes mounted in the plurality of apertures each having a tip portion protruding beyond a top conditioning surface of the conditioning disc.

In the conditioning head for conditioning and cleaning a polishing pad, each of the plurality of brushes is formed by a multiplicity of bristles. Each of the plurality of brushes may be formed of a height protruding at least 2 mm beyond the top conditioning surface of the conditioning disc, or formed of a height protruding between about 2 mm and 8 mm beyond the top conditioning surface of the conditioning disc. Each of the plurality of brushes may be formed of a multiplicity of bristles of nylon material, or of a polymeric material that has sufficient hardness for lasting a least 30 hours in conditioning a polishing disc, or of a polymeric material that is resistant to acid and base. Each of the plurality of apertures may have a diameter of at least about 5 mm, or between about 5 mm and about 10 mm. The plurality of apertures may be spaced-apart substantially equally in the surface of the peripheral region of the disc holder.

The present invention is further directed to a method for conditioning and cleaning a polishing head which may be carried out by the operating steps of providing a conditioning head formed by mounting a conditioning disc to a top surface of a disc holder exposing a peripheral region of the surface, mounting a plurality of brush means each has a multiplicity of bristles with tip portions protruding beyond a conditioning surface of the conditioning disc in the peripheral region of the top surface of the disc holder, and contacting the tip portions of the multiplicity of bristles with a surface of a rotating polishing pad.

The method for conditioning and cleaning a polishing pad may further include the step of rotating the conditioning head in a direction opposite to the rotational direction of the polishing pad, or the step of contacting the tip portions of the multiplicity of bristles with the surface of a rotating polishing pad under a pressure sufficient to clean out particles entrapped in surface grooves in the polishing pad. The method may further include the steps of providing a plurality of apertures in the peripheral region of the top surface of the disc holder, and inserting a multiplicity of bristles in each of the plurality of apertures forming the brush means.

The method for conditioning and cleaning a polishing pad may further include the step of inserting a multiplicity of bristles made of a polymeric material that is resistant to acid and base, or made of a material of nylon. The method may further include the step of providing the plurality of apertures in a diameter of at least 5 mm. The method may further include the step of mounting a plurality of brush means each has a multiplicity of bristles with tip portions protruding at least 2 mm beyond a conditioning surface of the conditioning disc, or protruding between about 2 mm and about 8 mm beyond a conditioning surface of the conditioning disc. The method may further include the step of contacting the tip portions of the multiplicity of bristles with the surface of a rotating polishing pad in-situ in a chemical mechanical polishing process of a wafer.

In another preferred embodiment of the present invention, a chemical mechanical polishing apparatus that is equipped with a slurry delivery arm and a pad conditioning head is provided which includes a wafer holder for holding a wafer to be polished therein, a polishing pad for engaging an active surface of the wafer, a slurry delivery arm for dispensing a slurry on a top surface of the polishing pad, a pad conditioning head for conditioning the top surface of the polishing pad, and a plurality of brush means mounted on at least one of the slurry delivery arm and the pad conditioning head in such a way that a multiplicity of bristles forming each of the plurality of brush means touches and cleans the top surface of the polishing pad while the pad is rotated at a pre-set rotational speed.

In the chemical mechanical polishing apparatus that is equipped with a slurry delivery arm and a pad conditioning head, the plurality of brush means is mounted on a bottom surface of the slurry delivery arm, or the plurality of brush means is mounted on a bottom surface of the pad conditioning head surrounding a pad conditioning disc, or the plurality of brush means is mounted on both the bottom surface of the slurry delivery arm and the bottom surface of the pad conditioning head surrounding a pad conditioning disc. The tip portions of the multiplicity of bristles protrude at least about 2 mm beyond the bottom surfaces of the slurry delivery arm and the pad conditioning head.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus and a method for cleaning a polishing pad during a pad conditioning process which can be conducted simultaneously. The pad cleaning process can be carried out either in-situ or ex-situ in a wafer polishing process by using a chemical mechanical polishing apparatus.

In the apparatus, a conditioning head is provided which is constructed by a disc holder and a conditioning disc mounted on the holder exposing a peripheral region for mounting a plurality of brush means. The brush means may be formed by first providing a plurality of apertures in the peripheral region, and then mounting a multiplicity of bristle in each of the plurality of apertures with a tip portion of the bristle protruding beyond a top conditioning surface of the conditioning disc. A suitable height of the tip portions of the multiplicity of bristles should be at least about 2 mm beyond the top conditioning surface of the conditioning disc, or can be provided at a height protruding between about 2 mm and about 8 mm beyond the top conditioning surface of the conditioning disc. The multiplicity of bristles can be formed of any one of a number of suitable polymeric materials that is acid and base resistant. For instance, the bristles can be formed in a nylon material that has sufficient hardness for cleaning the surface grooves on a polishing pad.

The present invention further provides a method for cleaning and conditioning a polishing pad in a chemical mechanical polishing apparatus. The method can be carried out by first mounting a plurality of brushes each formed of a multiplicity of bristles in the surface of a conditioning disc such that the tip portions of the bristles protrude beyond a conditioning surface of the conditioning disc by at least 2 mm to enable an efficient cleaning of surface grooves on the polishing pad. The method may further be carried out by mounting a plurality of brushes on the bottom surface of a slurry delivery arm such that during slurry delivery to a polishing pad in a chemical mechanical polishing process, the plurality of brushes sweeps the grooves in the pad surface and efficiently clean the pad surface and the grooves.

The present invention still further provides a chemical mechanical polishing apparatus that is equipped with a slurry delivery arm and a pad conditioning head, at least one of which is mounted with a plurality of brushes on a bottom surface facing a polishing pad which can be used in either in-situ or ex-situ cleaning of the pad surface.

Figure 4A:
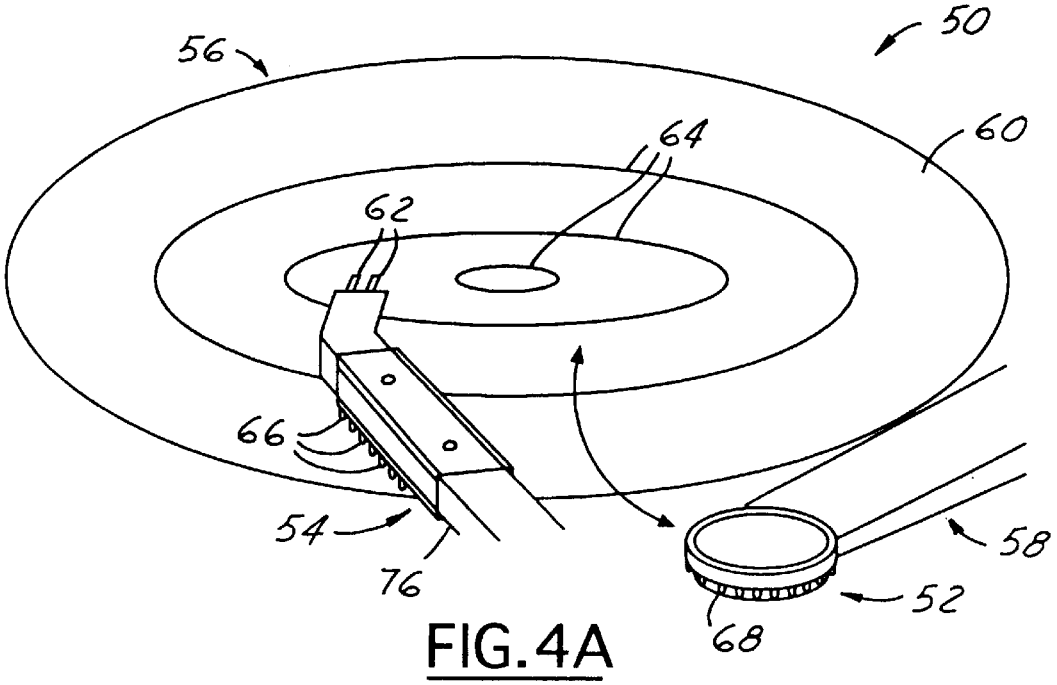
FIG. 4A is a perspective view of the present invention novel apparatus of a conditioning head and a slurry delivery arm equipped with a plurality of brush means positioned over a polishing pad.

Referring now to FIG. 4A, wherein a perspective view of the present invention apparatus 50 is shown. The apparatus 50 consists of a conditioning head 52 and a slurry delivery arm 54 positioned over a polishing pad 56. The conditioning head 52 is mounted on a conditioning arm 58 which is extended over the top of the polishing pad 56 and is capable of making sweeping motion across the entire surface of the polishing pad. The slurry delivery arm 54 is equipped with slurry dispensing nozzles 62 which are used for dispensing a slurry solution on the top surface 60 of the polishing pad 56. Surface grooves 64 are further provided in surface 60 to facilitate even distribution of the slurry solution dispensed thereon and to help entrapping undesirable particles that are generated by coagulated slurry solution, or any other foreign particles which have fallen on top of the polishing pad during a polishing process. The surface grooves 64 while serving an important function of distributing the slurry also presents a processing problem when the pad surface 60 gradually worn out after successive use.

Figure 4B:
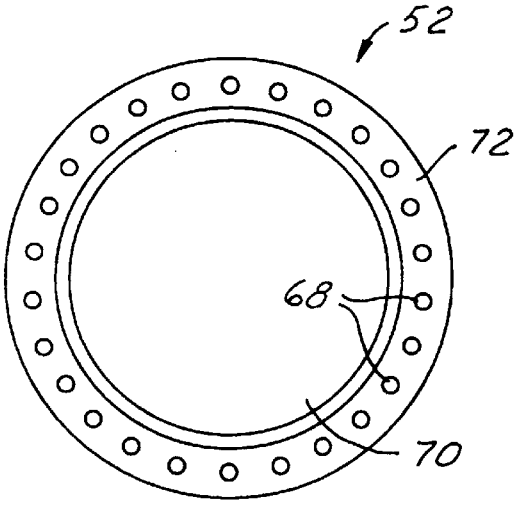
FIG. 4B is a plane view of the present invention conditioning head equipped with a plurality of brush means.
Figure 4C:
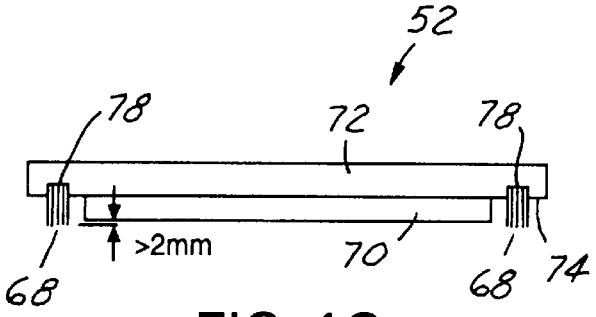
FIG. 4C is a cross-sectional view of the present invention conditioning head of FIG. 4B.

The present invention novel cleaning apparatus and method by utilizing a plurality of brush means is further shown in FIGS. 4B and 4C. FIG. 4B is a plane view of the conditioning head 52 of FIG. 4A, while FIG. 4C is a cross-sectional view of the conditioning head 52. A plurality of brush means 60 is mounted in a peripheral region, of a bottom surface 74 of disc holder 72 which is not covered by a conditioning disc 70. The plurality of brush means 68 can be mounted to the disc holder in any desirable manner and is not limited by the specific embodiment shown in FIG. 4C.

The embodiment shown in FIG. 4C can be easily implemented by first providing a plurality of apertures 78 in a top surface 74 of the disc holder 72, each of the apertures 78 may have a diameter of approximately 5 mm, or of any diameter in the range between about 5 mm and about 10 mm. A multiplicity of bristles, preferably made of a polymeric material that is acid and base resistant is then inserted into the apertures 78 forming the brush means 68. A suitable polymeric material that has sufficient hardness is nylon. It has been found that the bristle material should have a sufficient hardness for providing efficient cleaning of the pad grooves 64 and the pad surface 60. However, the bristle may not be too hard as to cause scratches on the pad surface 60. A suitable bristle hardness may be that frequently used in fabricating toothbrushes.

As shown in FIG. 4B, the plurality of brush means 68 is substantially spaced-apart at equal distance along the peripheral edge of the disc holder 72. However, any other placement pattern may also be used to achieve the same desirable result. When the brush means 68 is mounted on the slurry delivery arm 54, as shown in FIG. 4A, a pattern of a straight row of brushes mounted on the bottom surface 76 of the delivery arm 54 is used. A symmetrical row of brushes (not shown) may be mounted on the opposite side of arm 54 to further improve the cleaning efficiency.

It should be noted that, the brush means 68 mounted on the conditioning head and the brush means 66 mounted on the slurry delivery arm may be used alternatively or concurrently. Since the slurry delivery arm 54 is always extended over the polishing pad surface 60 during a CMP polishing process, the surface grooves 64 and the pad surface 60 are always cleaned by the brush means 66. The brush means 68 mounted on the conditioning head 52 may be extended over the polishing pad surface 60 only part of the time during a CMP polishing process. For instance, during a CMP process time of 40 seconds, the conditioning head may be positioned over the polishing pad surface 60 for cleaning only during the last 10 seconds. The time duration may be pre-programmed and therefore may be reset to any desirable time if necessary.

Since the slurry delivery arm 54 is in a fixed position, once extended over the polishing pad, the brush means 66 is always in contact with the pad surface 60. As a result, a shorter lifetime of the brush means 66 is usually obtained. The lifetime of the brush means 68 mounted on the conditioning head 52 may be longer, i.e., may exceed 50 hours since the conditioning head is not always in contact with the pad surface 60.

The tip portions of the multiplicity of bristles that form the brush means 66, 68 should protrude at least 2 mm beyond the top surface of the conditioning pad 70 or the bottom surface 76 of the delivery arm 54. Alternatively, the tip portions should protrude between about 2 mm and about 8 mm beyond the conditioning pad surface of the conditioning head or the bottom surface of the delivery arm.

Figure 1A:
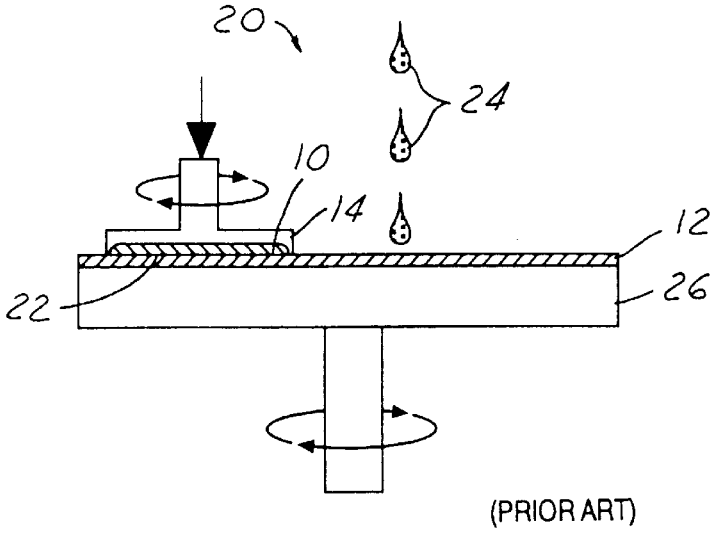
(PRIOR ART) FIG. 1A
FIG. 1A is a cross-sectional view of a conventional chemical mechanical polishing apparatus.
Figure 1B:
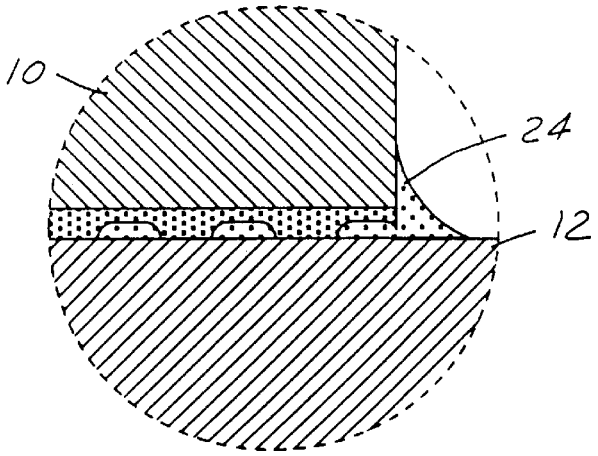
(PRIOR ART) FIG. 1B
FIG. 1B is a partial, enlarged cross-sectional view of FIG. 1A showing the interaction of slurry between the wafer and the polishing pad.
Figure 1C:
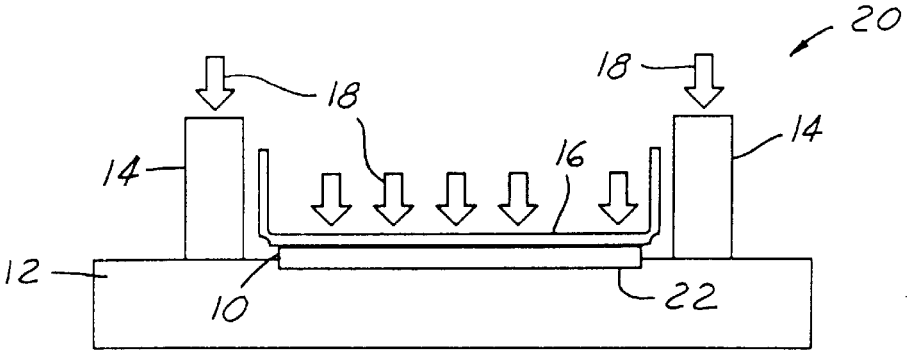
FIG. 1C (PRIOR ART)
FIG. 1C is a cross-sectional view illustrating a polishing head utilizing a membrane pressurizing device.
Figure 1D:
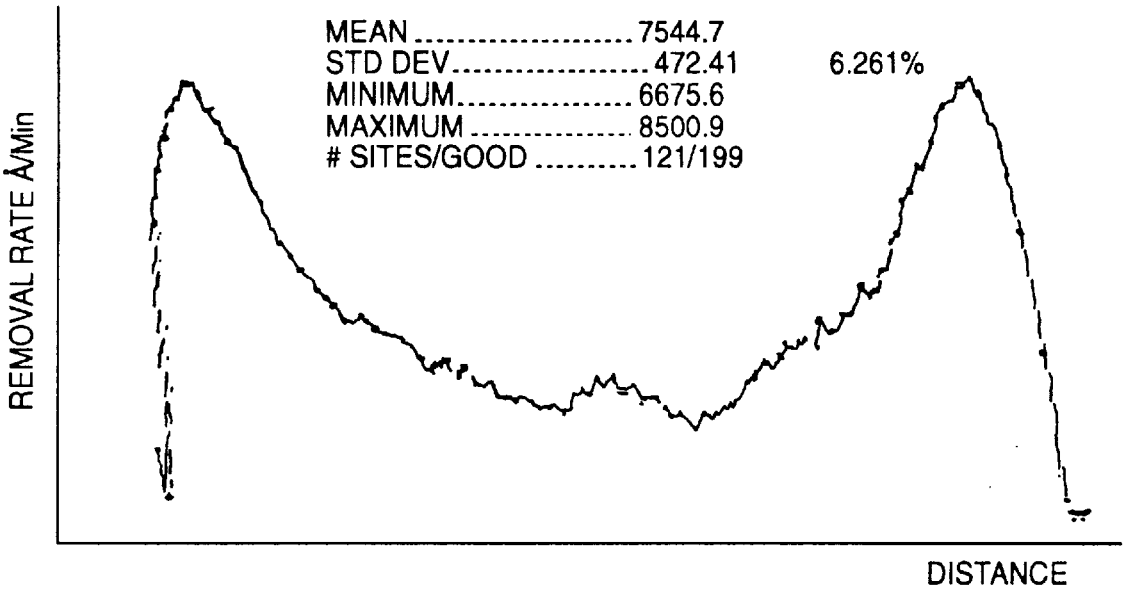
(PRIOR ART) FIG. 1D
FIG. 1D is a graph illustrating data obtained by using a conventional polishing pad showing the dependency of removal rates on the locations of a wafer surface.
Figure 2A:
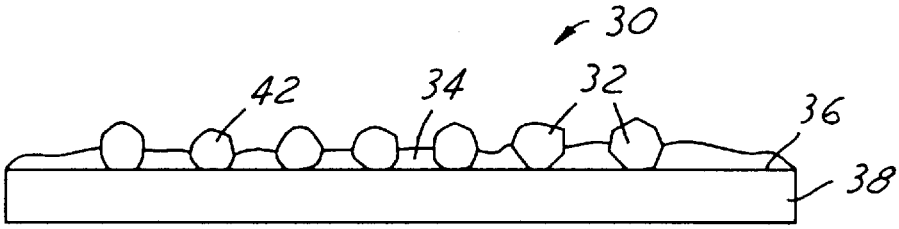
(PRIOR ART) FIG. 2A
FIG. 2A is a cross-sectional view of a conventional conditioning disc for use in polishing pad conditioning.
Figure 2B:
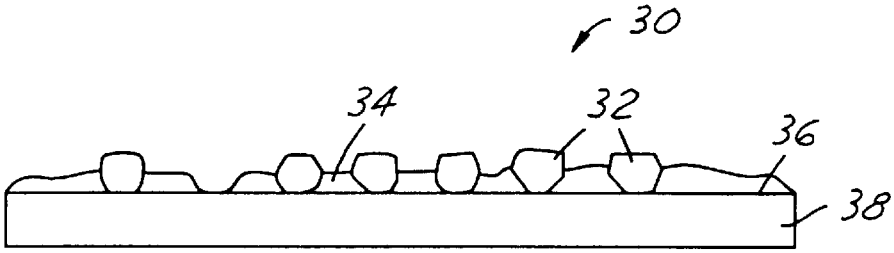
(PRIOR ART) FIG. 2B
FIG. 2B is a cross-sectional view of the conventional conditioning disc of FIG. 2A with a diamond particle missing from the pad surface.
Figure 3A:
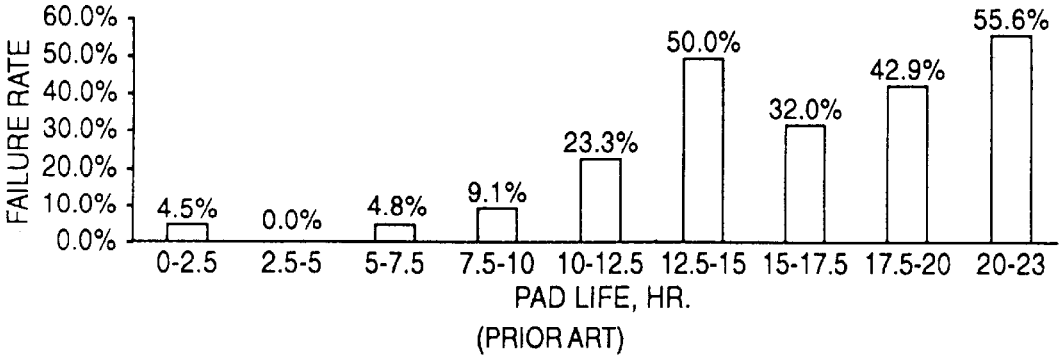
(PRIOR ART) FIG. 3A
FIG. 3A is a graph illustrating the dependency of failure rates in wafer polished on pad life in a conventional chemical mechanical polishing apparatus.
Figure 3B:
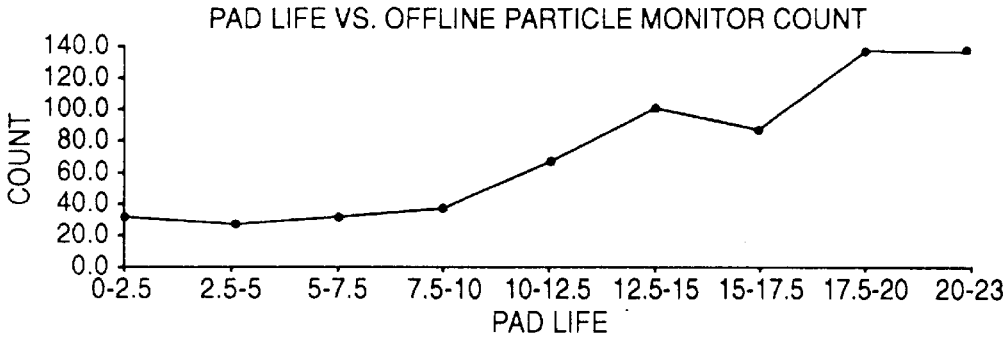
(PRIOR ART) FIG. 3B
FIG. 3B is a graph illustrating the dependency of particle counts on pad life in a conventional chemical mechanical polishing apparatus.
Figure 5:
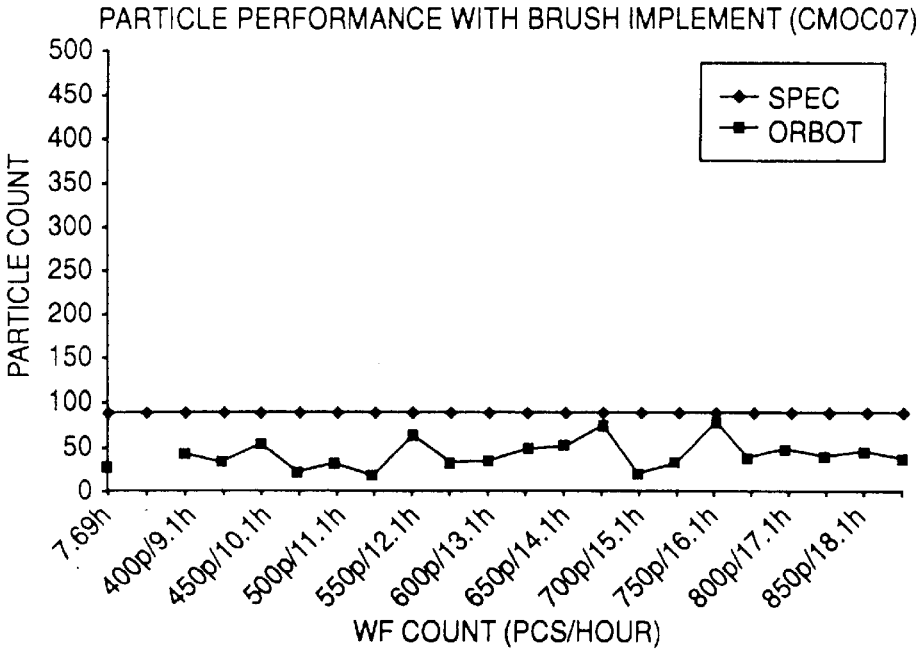
FIG. 5 is a graph illustrating the dependency of particle counts on pad life as indicated by wafers polished for a present invention conditioning head equipped with brush means.
Figure 3C:
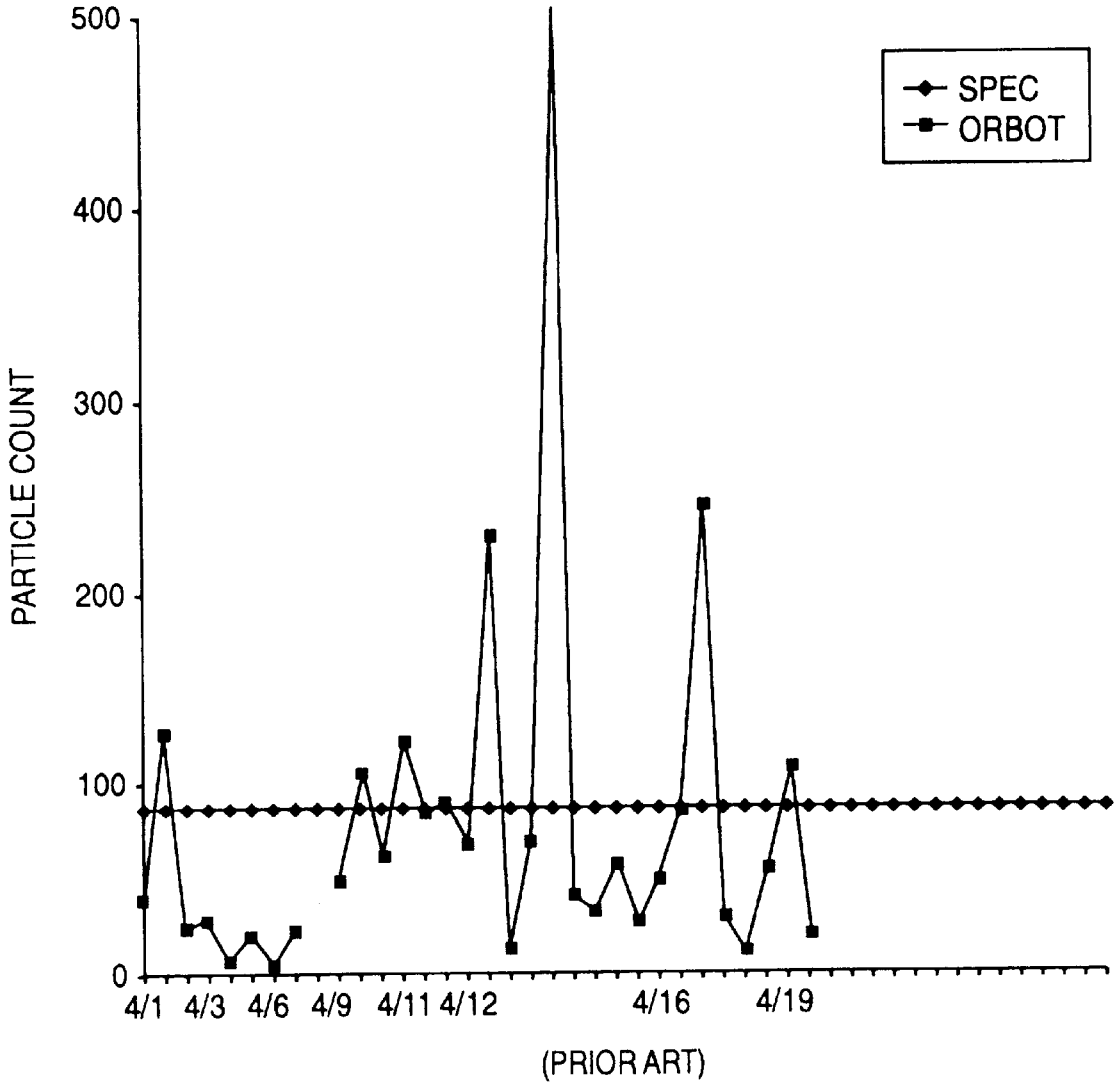
(PRIOR ART) FIG.3C
FIG. 3C is a graph illustrating the dependency of particle counts on pad life obtained on a commercial chemical mechanical polishing machine.

The desirable results obtained by utilizing the present invention modified conditioning head or modified slurry delivery arm are shown in FIG. 5, a graph plotted of particle counts versus pad life (or wafers polished). It is seen that after a pad life of 18 hours (or 850 wafers polished), the particle counts consistently rest below the allowable limit of 85 counts per wafer. This is a significant improvement when compared to the data obtained in a conventional CMP apparatus shown in FIG. 3C.

The present invention novel apparatus and method for cleaning a polishing pad has therefore been amply described in the above descriptions and in the appended drawings of FIGS. 4A~5.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

What is claimed is:

1. A conditioning head for conditioning and cleaning a polishing pad by removing particles trapped in pad grooves comprising:

a disc holder for holding a conditioning disc therein, said disc holder having a peripheral region not covered by said conditioning disc, a plurality of apertures spaced-apart in a surface of said peripheral region, each being adapted for holding a brush therein, and a plurality of brushes mounted in said plurality of apertures each having a tip portion protruding beyond a top conditioning surface of said conditioning disc.

2. A conditioning head for conditioning and cleaning a polishing pad by removing particles trapped in pad grooves according to claim 1, wherein each of said plurality of brushes being formed by a multiplicity of bristles.

3. A conditioning head for conditioning and cleaning a polishing pad by removing particles trapped in pad grooves according to claim 1, wherein each of said plurality of brushes being formed of a height protruding at least about 2 mm beyond said top conditioning surface of the conditioning disc.

4. A conditioning head for conditioning and cleaning a polishing pad by removing particles trapped in pad grooves according to claim 1, wherein each of said plurality of brushes being formed of a height protruding between about 2 mm and about 8 mm beyond said top conditioning surface of the conditioning disc.

5. A conditioning head for conditioning and cleaning a polishing pad by removing particles trapped in pad grooves according to claim 1, wherein each of said plurality of brushes being formed by a multiplicity of bristles made of nylon.

6. A conditioning head for conditioning and cleaning a polishing pad by removing particles trapped in pad grooves according to claim 1, wherein each of said plurality of brushes being formed by a multiplicity of bristles of a polymeric material having sufficient hardness to last at least 30 hours in conditioning a polishing disc.

7. A conditioning head for conditioning and cleaning a polishing pad by removing particles trapped in pad grooves according to claim 1, wherein each of said plurality of brushes being formed by a multiplicity of bristles made of a polymeric material that is resistant to acid and base.

8. A conditioning head for conditioning and cleaning a polishing pad by removing particles trapped in pad grooves according to claim 1, wherein each of said plurality of apertures having a diameter of at least about 5 mm.

9. A conditioning head for conditioning and cleaning a polishing pad by removing particles trapped in pad grooves according to claim 1, wherein each of said plurality of apertures having a diameter of between about 5 mm and about 10 mm.

10. A conditioning head for conditioning and cleaning a polishing pad by removing particles trapped in pad grooves according to claim 1, wherein each plurality of apertures are spaced-apart substantially equally.

11. A method for conditioning and cleaning a polishing pad comprising the steps of:

providing a conditioning head formed by mounting a conditioning disc to a top surface of a disc holder exposing a peripheral region of said surface, mounting a plurality of brush means each having a multiplicity of bristles with tip portions protruding beyond a conditioning surface of said conditioning disc in said peripheral region of said top surface of the disc holder, and contacting said top portions of said multiplicity of bristles with a polishing surface of a rotating polishing pad.

12. A method for conditioning and cleaning a polishing pad according to claim 11 further comprising the step of rotating said conditioning head in a direction opposite to the rotational direction of said polishing pad.

13. A method for conditioning and cleaning a polishing pad according to claim 11 further comprising the step of contacting said tip portions of said multiplicity of bristles with said surface of a rotating polishing pad under a pressure sufficient to clean out particles entrapped in surface grooves in said polishing pad.

14. A method for conditioning and cleaning a polishing pad according to claim 11 further comprising the steps of:

providing a plurality of apertures in said peripheral region of said top surface of the disc holder, and inserting a multiplicity of bristles in each of said plurality of apertures forming said brush means.

15. A method for conditioning and cleaning a polishing pad according to claim 14 further comprising the step of inserting a multiplicity of bristles made of a polymeric material that is resistant to acid and base.

16. A method for conditioning and cleaning a polishing pad according to claim 14 further comprising the step of inserting a multiplicity of bristles made of nylon.

17. A method for conditioning and cleaning a polishing pad according to claim 14 further comprising the step of providing said plurality of apertures having a diameter of at least 5 mm.

18. A method for conditioning and cleaning a polishing pad according to claim 11 further comprising the step of mounting a plurality of brush means each having a multiplicity of bristles with tip portions protruding at least 2 mm beyond a conditioning surface of said conditioning disc.

19. A method for conditioning and cleaning a polishing pad according to claim 11 further comprising the step of mounting a plurality of brush means each having a multiplicity of bristles with tip portions protruding between about 2 mm and about 8 mm beyond a conditioning surface of said conditioning disc.

20. A method for conditioning and cleaning a polishing pad according to claim 11 further comprising the step of contacting said tip portions of said multiplicity of bristles with the surface of a rotating polishing pad in-situ in a chemical mechanical polishing process.

21. A chemical mechanical polishing apparatus equipped with a slurry delivery arm and a pad conditioning head comprising:

a wafer holder for holding a wafer to be polished therein, a polishing pad for engaging an active surface of said wafer, a slurry delivery arm for dispensing a slurry on a top surface of said polishing pad, a pad conditioning head for conditioning sad top surface of the polishing pad, and a plurality of brush means mounted on at least one of said slurry delivery arm and said pad conditioning head in such a way that a multiplicity of bristles forming each of said plurality of brush means touches and cleans said top surface of the polishing pad while said polishing pad is rotated at a pre-set rotational speed.

22. A chemical mechanical polishing apparatus equipped with a slurry delivery arm and a pad conditioning head according to claim 21, wherein said plurality of brush means is mounted on a bottom surface of said slurry delivery arm.

23. A chemical mechanical polishing apparatus equipped with a slurry delivery arm and a pad conditioning head according to claim 21, wherein said plurality of brush means is mounted on a bottom surface of said pad conditioning head surrounding a pad conditioning disc.

24. A chemical mechanical polishing apparatus equipped with a slurry delivery arm and a pad conditioning head according to claim 21 wherein said plurality of brush means is mounted on a bottom surface of said slurry delivery arm and a bottom surface of said pad conditioning head surrounding a pad conditioning disc.

25. A chemical mechanical polishing apparatus equipped with a slurry delivery arm and a pad conditioning head according to claim 21, wherein tip portions of said multiplicity of bristles protruding at least about 2 mm beyond said bottom surfaces of said slurry delivery arm and said pad conditioning head.

* * * * *